US005099990A

United States Patent [19]

Antonious

[11] Patent Number: 5,099,990

[45] Date of Patent: Mar. 31, 1992

[54] GOLF CLUB HOLDER INSERT FOR A GOLF BAG

[76] Inventor: Anthony J. Antonious, 7738 Calle Facil, Sarasota, Fla. 34238

[21] Appl. No.: 541,508

[22] Filed: Jun. 21, 1990

[51] Int. Cl.[5] ..... A63B 55/04

[52] U.S. Cl. ..... 206/315.6

[58] Field of Search ..... 206/315.6, 315.8

[56] References Cited

U.S. PATENT DOCUMENTS

| | | | |
|---|---|---|---|
| 936,698 | 10/1909 | Breakspear | 206/315.6 |
| 1,417,380 | 5/1922 | Hatch | 206/315.6 |
| 1,434,621 | 11/1922 | Marwood et al. | 206/315.6 |
| 1,711,344 | 4/1929 | Evans | 206/315.6 |
| 1,809,536 | 6/1931 | Tucker | 206/315.6 |
| 1,849,610 | 3/1932 | Boyce | 206/315.6 |
| 1,876,134 | 9/1932 | Clawson | 206/315.6 |
| 2,568,810 | 9/1951 | Kish, Jr. | 206/315.6 |
| 4,667,820 | 5/1987 | Solheim | 206/315.3 |
| 4,796,752 | 1/1989 | Reimers | 206/315.3 |

FOREIGN PATENT DOCUMENTS

| | | | |
|---|---|---|---|
| 3132 | of 1912 | United Kingdom | 206/315.6 |

*Primary Examiner*—William I. Price
*Attorney, Agent, or Firm*—Nicholas J. Aquilino

[57] ABSTRACT

A golf club holder insert for use with a golf bag to hold a plurality of golf clubs and sized to snugly fit within the opening of the bag formed of a primary golf club holding compartment and a plurality of secondary shaped golf club holding compartments attached about the primary club holding compartment. The primary compartment extends above the secondary compartments to separate golf clubs stored in the primary compartment from the golf clubs in the secondary compartments to protect the clubs and club shafts from damage caused by contacting other clubs in the bag.

8 Claims, 8 Drawing Sheets

GOLF CLUB HOLDER INSERT FOR A GOLF BAG

BACKGROUND OF THE INVENTION

The present invention relates to golf bags for holding golf clubs used in playing a game of golf, and more particularly to a golf club holder insert designed to be inserted within the opening of a standard golf bag for holding golf clubs.

Many conventional golf bags include various size and shape top dividers which span the opening of the golf bag for the purpose of separating and dividing the golf clubs placed within the bag. One shortcoming of these dividers, which are mostly located at the upper portion of the golf bag only, is that the divider structure allows the clubs to become entangled with each other adjacent the bottom of the bag which often causes difficulty in removing a particular club, and may result in damage to the club shaft and/or grip.

It is well known to separate the individual clubs using a series of elongated, tubular members which extend from the top opening to the bottom of the bag. A shortcoming of this type of divider system is that the opening for the individual clubs is relatively small and requires precise alignment of the grip end of the club before a club may be inserted back into the bag. Also, there is no flexibility in movement in removing a club, requiring that it be lifted almost straight up in a vertical direction so that the club grip does not scrape the interior edged sides of the divider.

Other more general shortcomings of golf bag structures and particular golf bag dividers is that the top edge of the dividers are normally below the top edge of the golf bag opening and these structures permit the iron heads of the shorter clubs to impact the hosel and shaft areas of the longer clubs, thereby inflicting damage to them. This is particularly critical with the advent of the more sophisticated graphite shafts where the shaft coating is made of material which can be easily damaged. Constant wear caused by the other golf clubs often results in damage or wear to the shafts or to the paint coating thereby producing an unsightly and distracting area on the shaft visible to a golfer using the club.

The present invention relates to a stationary golf club holder insert for golf bags designed to be secured in the opening of golf bags as original equipment or as a replacement for dividers.

The inserts of the present invention use a primary compartment which is raised above the other compartments and which is structured to separate and protect the golf clubs and shafts of the clubs stored in the compartment from being damaged by the other clubs stored in the golf bag.

A preferred embodiment of a golf club holder insert includes a first inner central compartment and a series of outer compartments radially disposed about the central compartment. The central compartment includes wall surfaces which extend in a vertical direction above the outer compartments, such that golf clubs stored in the central compartment are separated from making contact with golf clubs stored in any of the radially disposed outer compartments. Preferably, the inner central compartment is round in shape, although other embodiments of the invention comtemplate a variety of other shapes, such as square, rectangular, oval, or any other geometric shape.

The outer compartments of the divider are located between the outer wall of the central compartment and the inner wall of the outer periphery of the insert. The dividers extend to the top edges of the central compartment in some embodiments, whereas in others, the central compartment is raised substantially above the dividers.

Another golf club holder insert preferably extends the entire length of the bag from the top opening to the bottom and is made with between five and seven openings to accommodate the clubs. Each insert includes a circular center opening compartment and a plurality of from four to six arcuate compartments, each adapted to accommodate from one to three golf clubs placed therein. Preferably, the circular center compartment is raised approximately three inches above the levels of the other compartments, which protects the expensive wood or metal-wood shafts from being struck by the shorter iron type club heads, thereby eliminating the damage to them.

Yet another embodiment of the golf club holder insert is formed with a circular center compartment and two opposing spaced apart individual arcuate compartments with full length dividers. When inserted into a suitably sized golf bag, the club holder insert also creates two additional club holding compartments located between the two opposing insert compartments, formed in part by the inner wall of the golf bag itself, for a total of five individual club holding sections.

Another embodiment includes a circular center compartment and three symmetrically spaced individual compartments with full length dividers. When inserted into a golf bag, a total of seven club holding sections are formed.

Among the objects of the present invention are the provision of a full length golf club holder insert which may be provided as original equipment, or as a replacement structure for conventionally shaped golf bags.

Another object of the present invention is to provide a golf club insert having a plurality of club receiving openings each structured to receive from one to three golf clubs, thereby permitting easy removal and a simplified means of insertion of golf clubs out of and back into the golf bag while separating the various clubs in accordance with the preferance of the individual golfer.

Still another object is the provision of a golf club holder insert having a raised primary compartment structured to receive the longer golf clubs and protect the longer clubs from damage from the club heads of the shorter clubs.

These and other objects will become apparent with reference to the following specifications and accompanying drawings.

DESCRIPTION OF THE PREFERRED EMBODIMENTS

Figure 1:
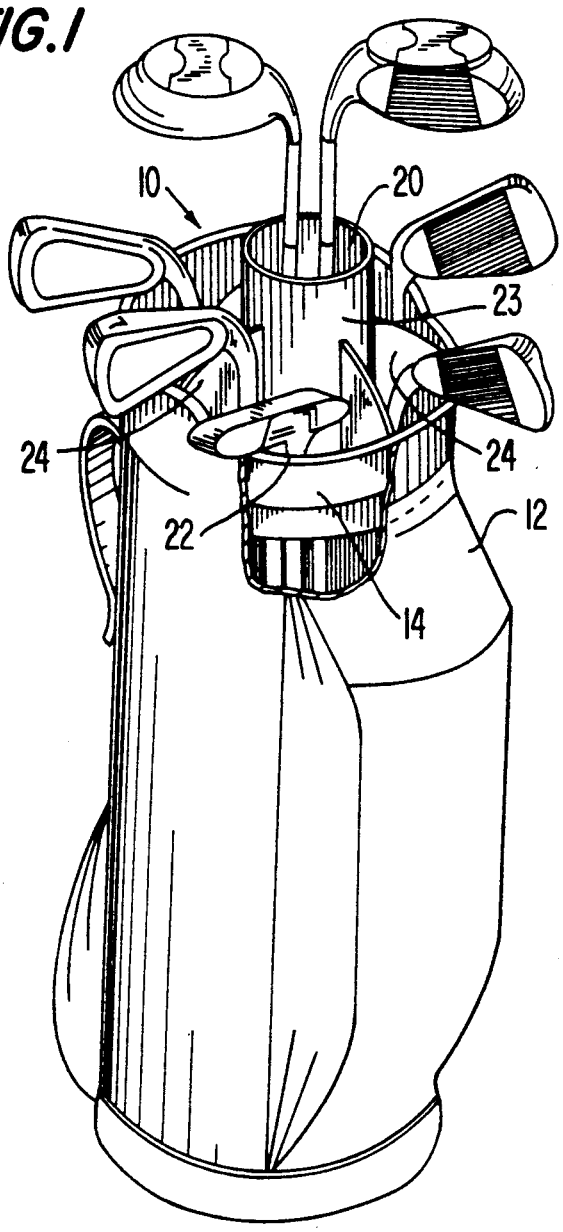
FIG. 1 is a perspective view of a golf bag holding a plurality of golf clubs, partly in section, with a golf club holder insert of the present invention.
Figure 2:
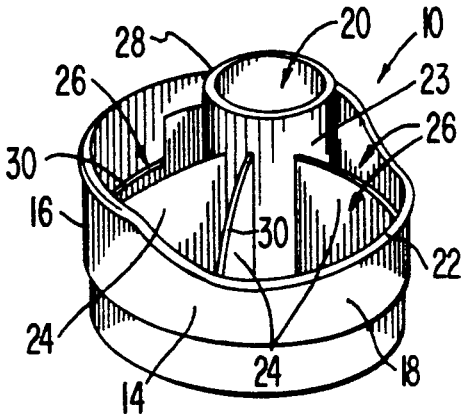
FIG. 2 is a perspective view of a golf club holder insert unattached to a golf bag.
Figure 4:
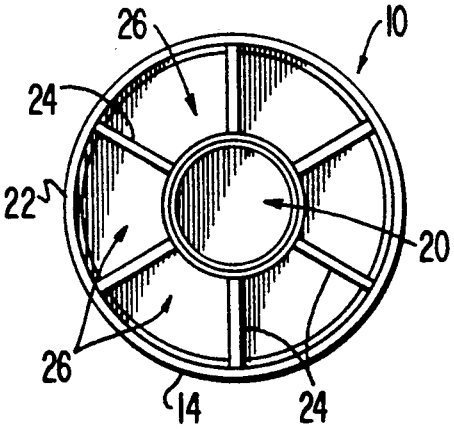
FIG. 4 is a top plan view of the insert of FIG. 2.
Figure 3:
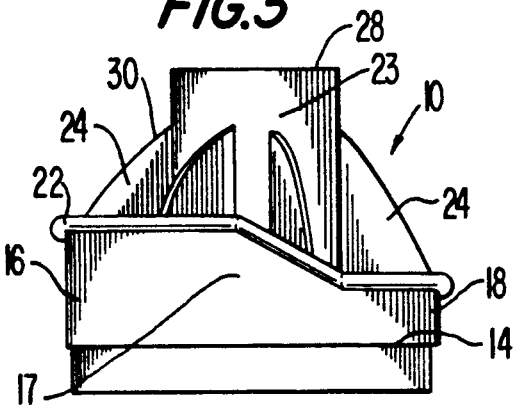
FIG. 3 is a side elevational view of the insert of FIG. 2.

Referring to the drawings, FIGS. 1 to 4 show a dome shaped club holder insert 10 which is structured to be attached to or integrally formed with the top opening of a conventional golf bag 12 to divide or separate the clubs placed in the bag. The insert includes an outer annular wall 14, the diameter of which corresponds to the size of the golf bag with which it is used. The outer wall is preferably provided with a two-level height configuration including a high portion 16 and a low portion 18 to generally accommodate variations in the length of the clubs being held within the bag. As shown, the transition from the high portion 16 to the low portion 18 is achieved by an intermediate portion 17 having an upper rim 22 angled along a portion of its length. It will be appreciated that the shorter iron golf clubs are placed in compartments adjacent the low annular wall portion 18, whereas longer iron clubs are placed adjacent the higher outer wall portions 16 and 17.

In keeping with the present invention, the insert 10 is formed with a raised compartment 20 generally centrally located with respect to the annular wall 14 and which extends above the upper rim 22 of the annular wall 14. The central compartment 20 has an outer wall 23 and is preferably formed in a tubular or cylindrical shape, although it will be appreciated that other shapes are equally applicable as described hereinbelow. A series of dividers 24 form a plurality of compartments 26 which are radially spaced from the outer wall 23 of the central compartment 20. The dividers 24 incline upwardly from below the upper rim 22 of the annular wall 14 to the outer wall of the central compartment 20. As can be seen from the drawings, the upper edge 28 and the outer wall 23 of the central compartment 20 is substantially raised above the upper edges 30 of the dividers 24. This structure separates golf clubs placed within the central compartment 20 from golf clubs placed within the radial compartments 26. For example, if wood type golf clubs, having shafts made of special materials such as graphite, boron graphite, titanium and the like, are placed in the central compartment, these clubs are separated and protected from the shorter iron type golf club heads which would normally be kept in the outer radial compartments 26. Each compartment, including the central compartment, is structured to receive two to more golf clubs without crowding. With a normal set of fourteen golf clubs, there would be two clubs for each compartment, there being a total of seven compartments in this embodiment. If a player chooses to use three or even four wood type golf club heads, they could be accommodated within the central compartment 20. The high divider walls 24 which connect the central compartment to the outer annular wall 14 also serve to restrict movement of the specific clubs within the compartments 26, thereby further minimizing damage between adjacent club heads and/or shafts, assuring that golf clubs held in the compartments 26 would not interfere with or contact clubs stored in the central compartment 20.

Since the wood type golf clubs are most often used by the average golfer, the fact that they are centrally located within the central compartment makes it easy for a player to gain access to these clubs in order to remove or replace them from and into the golf bag, respectively. The other more frequently used iron type golf clubs with the higher lofts would be placed within the compartments 26 adjacent the low portion 18 of the outer wall 14, these compartments being readily accessable to the player.

For example, with a golf bag having a nine inch opening, the central compartment preferably would be at least three inches in diameter or more depending upon the number of clubs it was designed to hold. The central compartment 20 extends from one to three inches above the top edge 22 of the annular divider 14.

Figure 5:
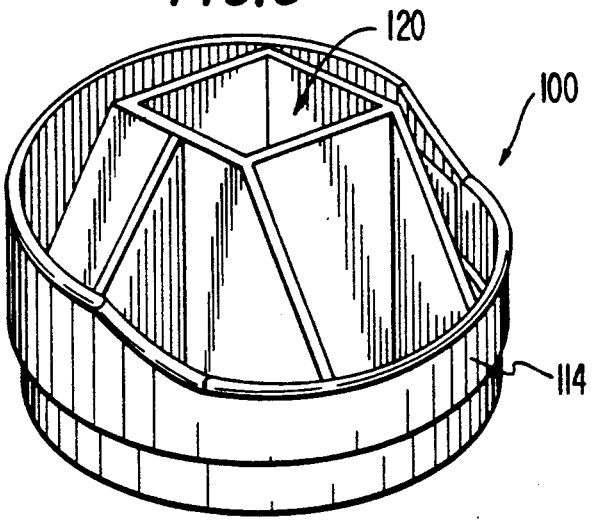
FIG. 5 is a perspective view of an embodiment of a golf club holder insert.
Figure 6:
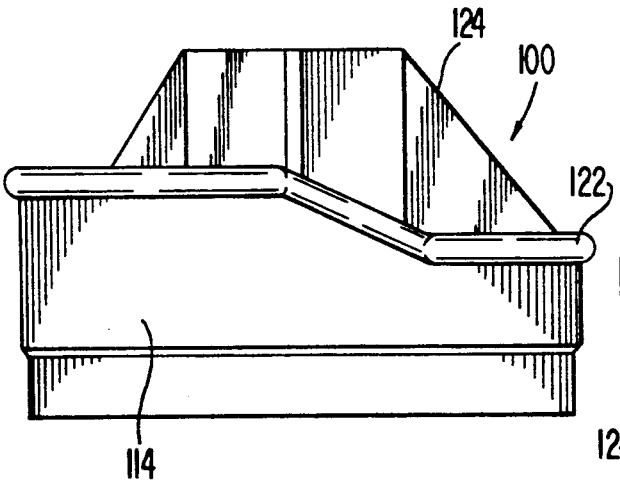
FIG. 6 is a side elevational view of the insert of FIG. 5.
Figure 7:
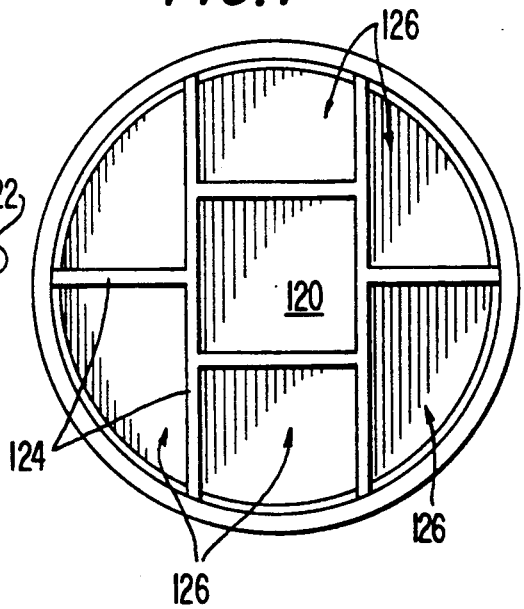
FIG. 7 is a top plan view of the insert of FIG. 5.

FIGS. 5, 6 and 7 show an example of a club holder insert 100 which is similar in structure to the embodiment shown in FIGS. 1 to 4 except that the central compartment 120 is square in shape and the plurality of compartments 126 have at least one square corner corresponding to the central compartment 120. In this embodiment, the central compartment 120 is also raised with respect to the outer annular wall 114 and a plurality of dividers 124 interconnect the outer wall of the central compartment with the outer annular wall 114. As shown, the top surface of the dividers 124 are inclined upwardly from the top edge 122 of the outer annular wall 114 to the top edge of the central compartment. These individual dividers tend to keep clubs held in the various compartments 126 from hitting each other. Golf clubs placed within the central compartment 120 are protected from being hit by the other golf clubs in the outer compartments 126.

Figure 8:
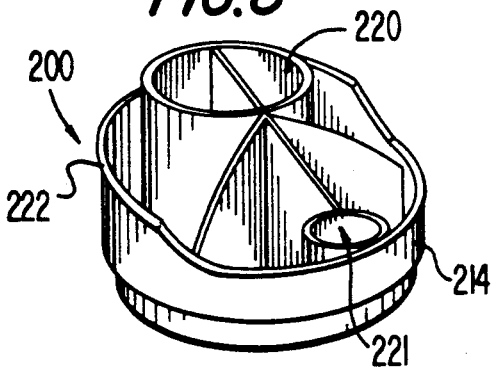
FIG. 8 is a perspective view of another embodiment of a golf club holder insert.
Figure 9:
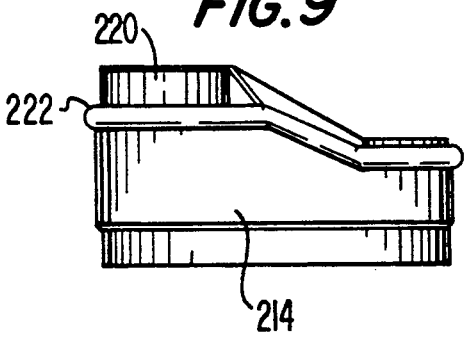
FIG. 9 is a side elevational view of the insert of FIG. 8.
Figure 10:
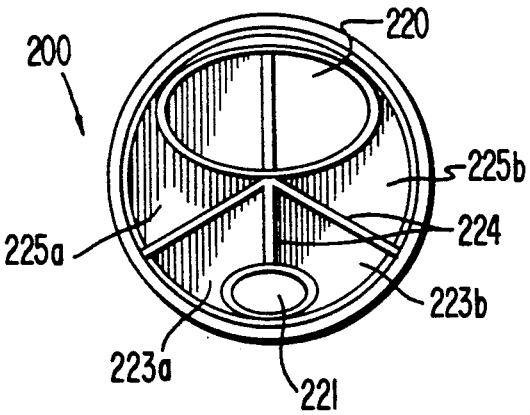
FIG. 10 is a top plan view of the insert of FIG. 8.

FIGS. 8, 9, and 10 show a club holder insert 200 having a series of eccentrically located golf club compartments arranged within the outer annular wall 214 of the insert. The unit includes an oval compartment 220 divided in two sections which is raised above the top rim 222 of the annular wall 214. The oval compartment 220 is similar to the central compartment of the embodiments described hereinabove, and it is designed to protect the wood shafts in the same way.

This insert 200 also includes a series of various shaped compartments 221, 223*a*, 223*b*, 225*a* and 225*b* to accommodate the other golf clubs used in the set. Compartment 221 has an outer annular wall connected to the outer wall of the insert. Dividers 224 incline upwardly to the top surface of the central compartment and form compartments 223*a*, 223*b*, 225*a*, and 225*b*.

Figure 11:
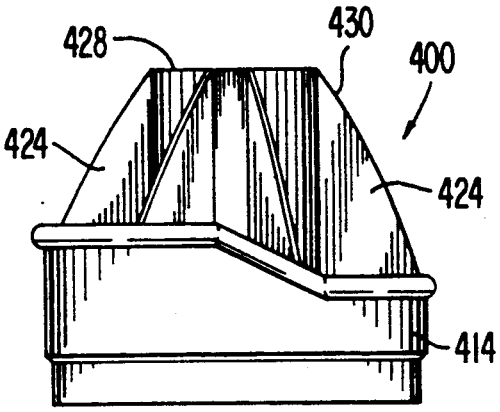
FIG. 11 is a side elevational view of a further embodiment of a golf club holder insert.
Figure 12:
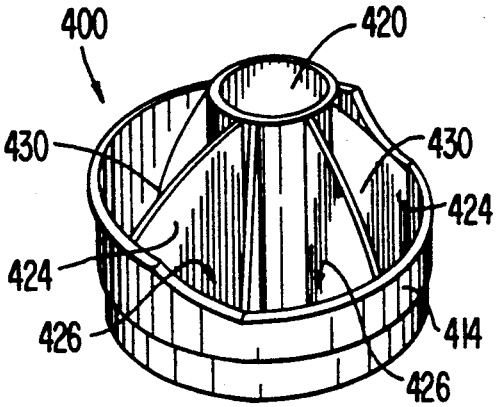
FIG. 12 is a perspective view of the insert of FIG. 11.

FIGS. 11 and 12 show another embodiment of a club holder insert 400 of the present invention including an outer annular wall 414 and an inner compartment 420. In this embodiment, the top edge 428 of the central compartment 420 is coincident with the top edges 430 of the dividers 424 which serve to form the plurality of radial compartments 426 as with the embodiment shown in FIGS. 1 to 4. Any golf clubs placed within the central compartment 420 are equally protected against movement of the clubs in the same manner as described hereinabove.

Figure 13:
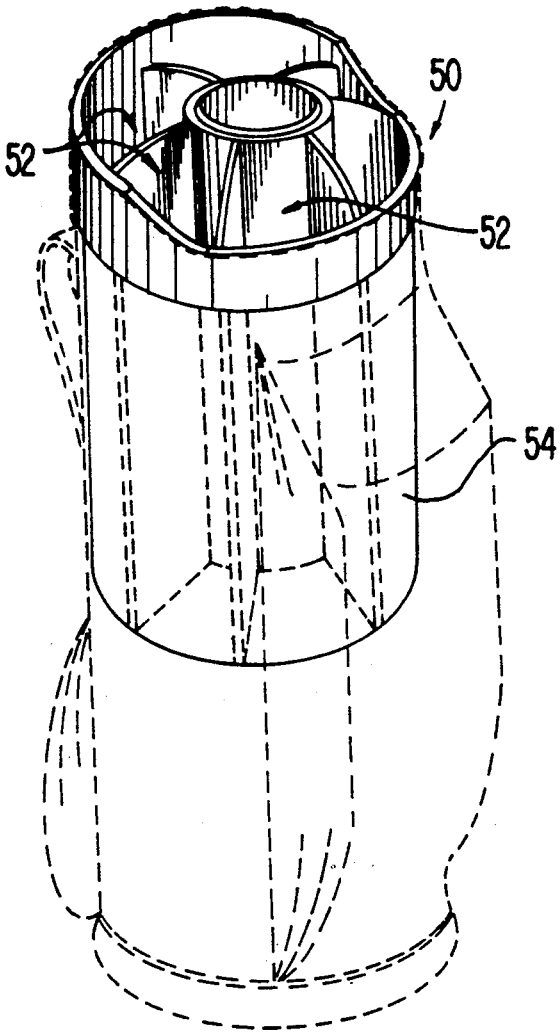
FIG. 13 is a perspective view of a still further embodiment of a golf club holder insert with a golf bag shown in phantom lines.

FIG. 13 shows a club holder insert 50 which is similar in structure to the embodiment in FIGS. 1 to 4 and 11 and 12, except the divider compartments 52 extend approximately half way of the vertical length of a golf bag when it is inserted into the top opening. An outer annular sleeve 54 similarly extends along approximately half of the vertical length of the bag and forms an outer wall for each compartment 52. The embodiments of FIGS. 5 through 7 and 8 through 10 can similarly be designed to extend an additional length into the bag, thereby providing greater stability to the clubs held by the insert.

Figure 14:
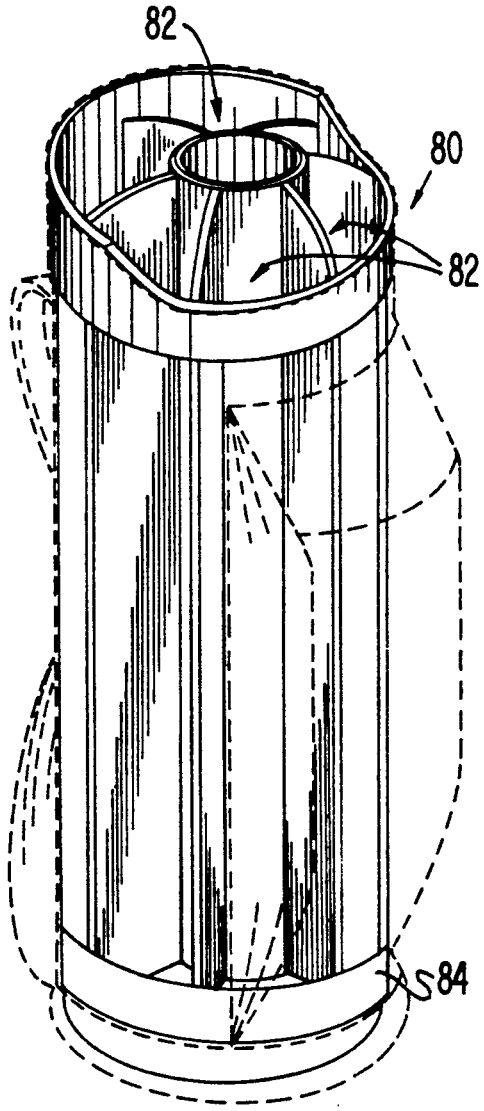
FIG. 14 is a perspective view of yet another embodiment of a golf club holder insert with a golf bag shown in phantom lines.

FIG. 14 shows a club holder insert 80 which also is similar to the embodiment of FIGS. 1 to 4 and 11 and 12 except the divider compartments 82 extend the full length of a golf bag when it is inserted into the top opening. No outer sleeve is provided, but the bottom of the insert includes a collar 84 to strengthen the insert 80 at the bottom. Again, the other embodiments can be designed to extend along the entire length of the bag.

Figure 15:
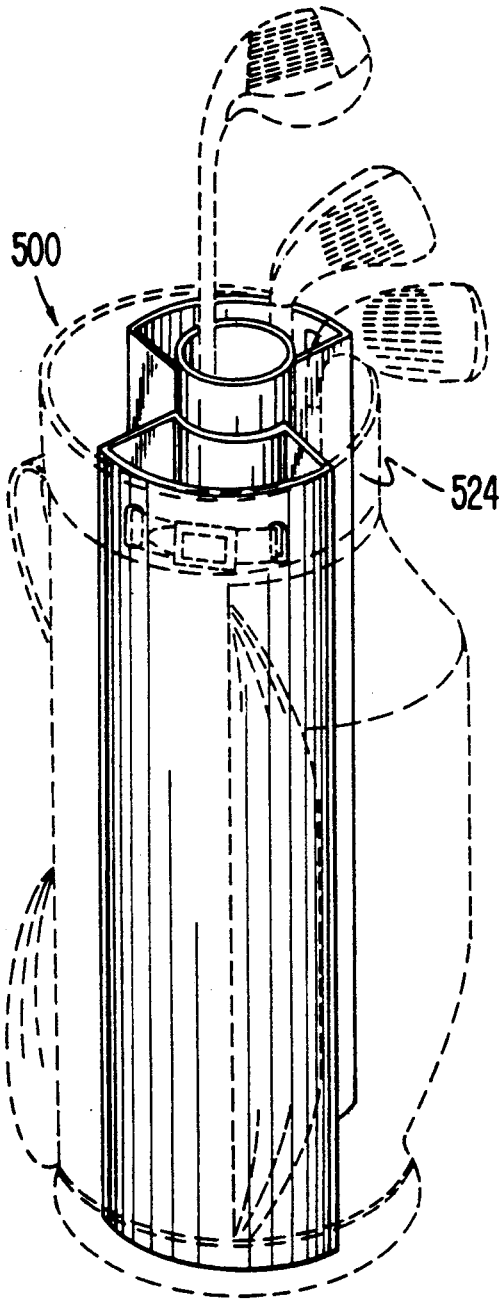
FIG. 15 is a perspective view, partly in section, of a golf club holder insert within a conventional golf club bag holding a plurality of clubs.
Figure 16:
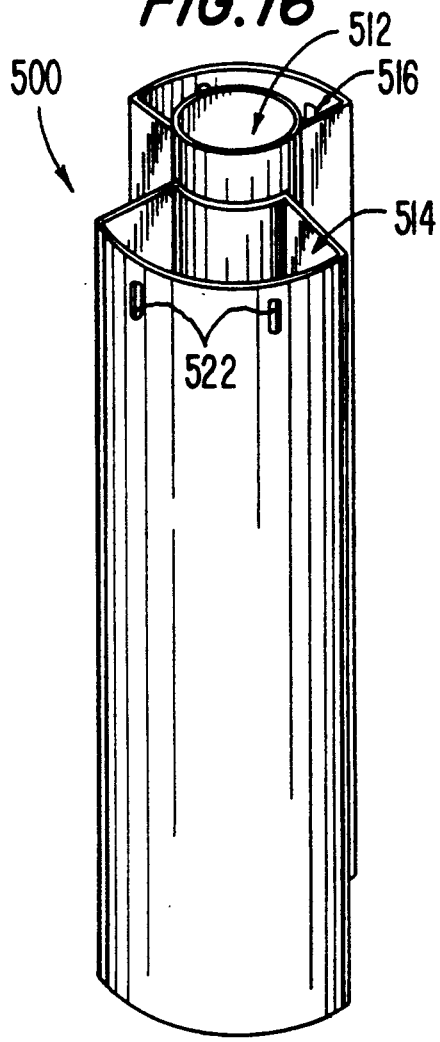
FIG. 16 is a perspective view of the insert of FIG. 15 separated from a golf bag.
Figure 17:
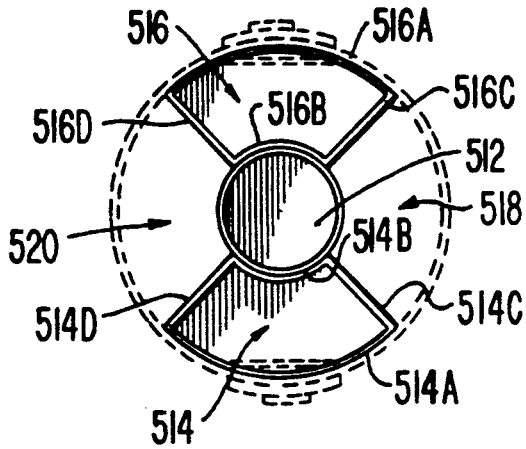
FIG. 17 is a top view of the insert within a golf bag.

Referring to the drawings, FIGS. 15 through 17 show a golf club holder insert 500 for a golf bag having a generally elongated, semi-cylindrical structure, the diameter of which is designed to fit within a particular sized opening of a golf bag. It will be appreciated that the overall size and diameter of the insert 500 can be varied to accommodate various length and diameter golf bags. For example, a conventional golf bag normally has an eight, nine or ten inch golf club holder opening, and therefore the overall diameter of the insert would be sized to snugly fit within the particular sized opening of the bag.

As can be seen from the drawings, the insert 500 includes a central compartment 512 which is cylindrical and extends the entire vertical length of the insert 500. The central compartment 512 extends above the rest of the insert and is designed to accommodate the extra length of wood or metal-wood golf clubs. The insert includes a front compartment 514 and a rear compartment 516 which are also full length and extend from the top of the opening of the conventional golf bag to the bottom shelf thereof. The compartments 514 and 516 are symmetrically placed on opposite sides of the central compartment 512. Each compartment 514 and 516 is arcuate in shape as particularly can be seen in FIGS. 16 and 17. Arcuate compartment 514 is formed of an outer arcuate wall 514*a*, an inner arcuate wall 514*b* which may be integral with or attached to the outer wall of inner compartment 512, and side walls 514*c* and 514*d*. It will be appreciated that the radius of curvature of the outer arcuate wall 514 corresponds to the complementary inner wall of a conventional golf bag. Similarly, compartment 16 is formed of outer arcuate wall 516*a*, inner arcuate wall 516*b* and side walls 516*c* and 516*d*.

As particularly shown in FIG. 17, when the insert 500 is positioned within the opening of a golf bag, shown in phantom lines, the spaces on either side of the central compartment 512 between the arcuate compartments 514 and 516 form two additional compartments 518 and 520 formed with the side walls 514*c*, 514*d*, 516*c* and 516*d* along with the inner wall surface of the golf bag.

A series of slots 522 are formed adjacent the top edges of each of the compartments 514 and 516 respectively and accommodate straps which secure the insert 500 through complementary openings on the top collar 524 of a golf bag.

In use, the insert provides five separate compartments to accommodate the normal complement of fourteen golf clubs used by a golfer. It is contemplated that the central circular compartment 512 will accommodate various wood or metal-wood type golf clubs, many of which are now provided with exotic and somewhat fragile shafts and shaft finishes. Each of the arcuate compartments 514, 516, 518 and 520 preferably would contain from one to three of the iron type golf clubs. For example, compartment 514 may be used to hold the normal complement of two or three wedges used by a golf player, compartment 518 may accommodate, for example, the seven, eight and nine irons, compartment 520 may accommodate the four, five and six irons, and compartment 516 may accommodate the two and three irons as well as a putter. No matter what selection of golf clubs a golfer chooses to play with, the invention provides an insert which permits arrangement of the clubs so they are readily accessable to the player while at the same time separating the clubs, thereby preventing entanglement and/or damage when a club is removed or inserted back into the golf bag.

The central compartment 512, while not only protecting the shafts of the longer clubs, centrally locates the longer hitting wood type clubs which are most often used by a golf player.

In addition, the golf club insert provides an aesthetically pleasing arrangement whereby the golf clubs may be stored within the bag in a symmetrical and orderly manner making it relatively simple for the player to choose a particular club, thereby eliminating the possibility of removing an incorrect club from the bag.

The embodiment shown in FIGS. 15 through 17 can readily be designed to include additional features shown in the previous embodiments. For example, the side walls 514*c*, 514*d*, 516*c*, and 516*d* can include top edges that incline upwardly from lower outer arcuate walls 514*a* and 516*a* to higher inner arcuate walls 514*b* and 516*b*. In addition, the rear compartment 516 can be designed to be taller than the compartment 514, so that shorter iron clubs can be placed within compartment 514, longer iron clubs can be placed in compartment 516, and intermediate iron clubs can be placed in compartments 518 and 520.

Figure 18:
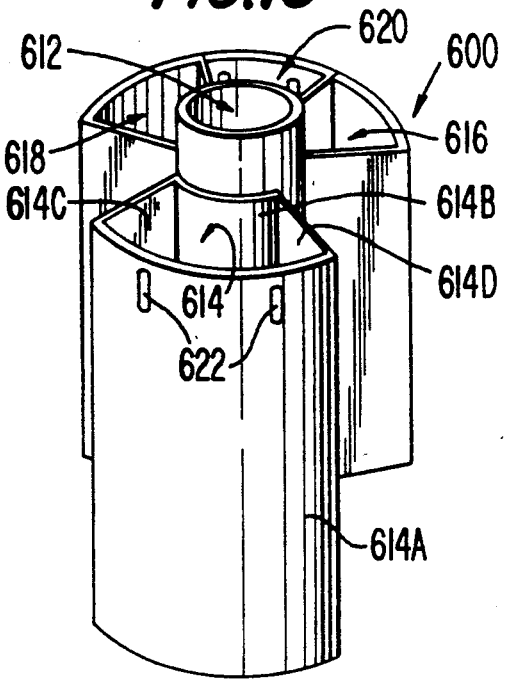
FIG. 18 is a perspective view of still another embodiment of a golf bag insert of the present invention.
Figure 19:
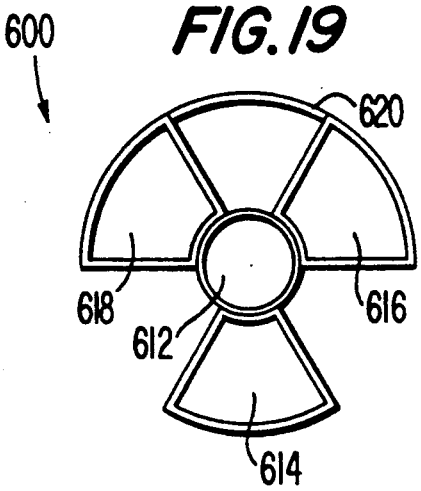
FIG. 19 is a top view thereof.

FIGS. 18 and 19 illustrate another embodiment of a golf club holder insert 600 of the present invention. In this embodiment, the insert 600 includes a circular central compartment 612 and three radially spaced arcuate outer compartments 614, 616 and 618. Compartments 614, 616 and 618 are provided with inner and outer arcuate walls and connecting side walls as, for example, outer arcuate wall 614*a*, inner arcuate wall 614*b* and side walls 614*c* and 614*d*, respectively. In this embodiment, an arcuate spanner member 620 is connected between compartments 616 and 618 specifically to accommodate slotted openings 622 formed therein to receive the connecting straps for attaching the insert 600 to the interior of the golf bag as described with respect to the previous embodiment hereinabove. It will be appeciated that the spanner member 620 need only be a few inches high for this purpose.

When the insert 600 is secured within a golf bag, not shown, it will be appreciated that a total of seven compartments will be formed to accommodate the various golf clubs. In addition to the central compartment 612 and the three arcuate compartments 614, 616 and 618, there will be three additional compartments formed using the inner wall of the golf bag and the spaces located between compartments 614 and 616, 616 and 618, and 618 and 614, respectively.

As with the first embodiment, the central compartment 612 extends above the overall upper surface of the insert to provide a barrier between the shafts of the longer golf clubs and the heads of the shorter irons.

The arrangement of seven openings provides a golfer with a still greater variety of positions to store and arrange the golf clubs to make them readily accessable for his individual needs.

Figure 20:
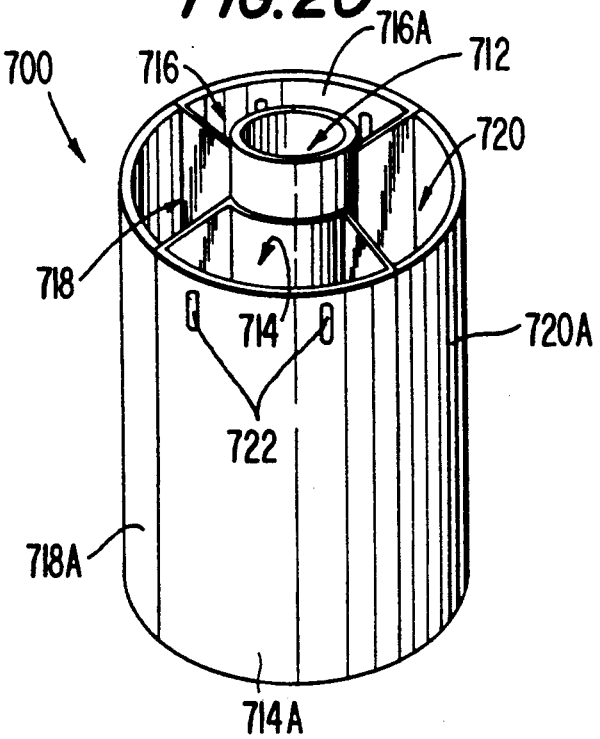
FIG. 20 is a perspective view of a further embodiment of a golf bag insert of the present invention.
Figure 21:
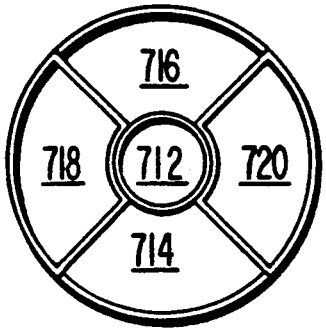
FIG. 21 is a top view thereof.

Another embodiment of a golf club holder insert 700 is shown in FIGS. 20 and 21 formed of a circular central compartment 712 and four equally spaced arcuate compartments 714, 716, 718 and 720 extending from the central compartment. In this embodiment, each of the arcuate compartments are provided with arcuate outer walls 714*a*, 716*a*, 718*a* and 720*a*, and are particularly useful when used with a golf bag having non-rigid inner walls. In other respects, the insert performs essentially the same as the embodiment of FIGS. 15 through 17 and includes the feature of an extended central compartment 712 and the provision of slots 722 to accommodate straps for connection to the golf bag.

Figure 22:
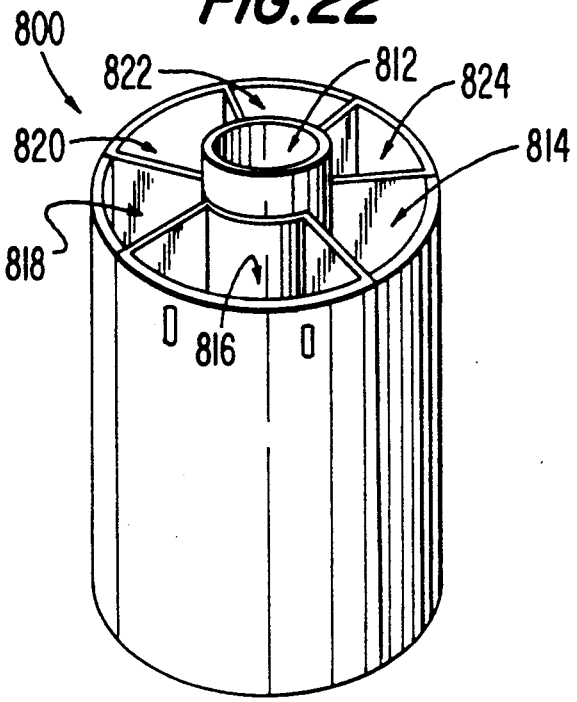
FIG. 22 is a perspective view of yet another embodiment of the present invention.
Figure 23:
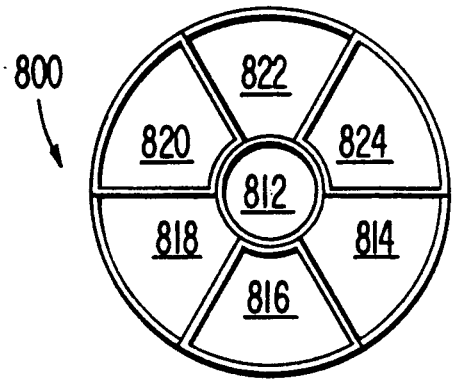
FIG. 23 is a top view thereof.

FIGS. 22 and 23 show another embodiment of a golf club holder insert 800 formed of a central circular compartment 812 and a series of six arcuate compartments 814, 816, 818, 820, 822 and 824. As with the embodiment shown in FIGS. 20 and 21, each of the arcuate compartments include solid outer arcuate walls which extend the entire vertical length of the insert to provide a total of seven club holding compartments.

Figure 24:
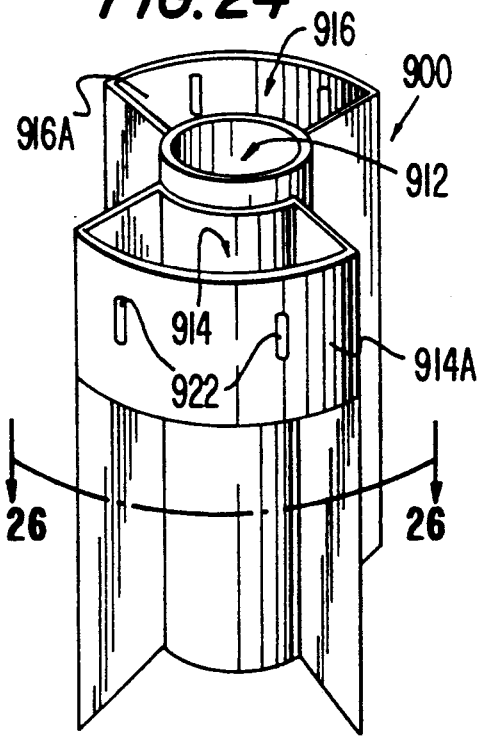
FIG. 24 is a perspective view of another embodiment of the golf club insert attached to a golf bag.
Figure 25:
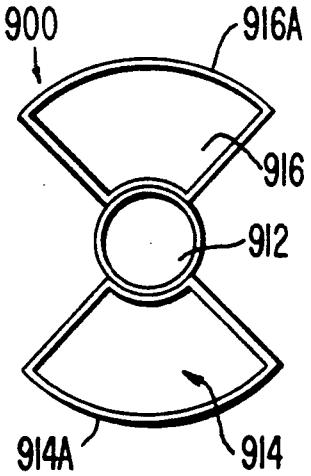
FIG. 25 is a top view of the insert of FIG. 24.
Figure 26:
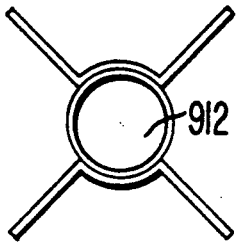
FIG. 26 is a sectional view taken along the lines 26—26 of FIG. 24.

Yet another embodiment of the golf club holder insert 900 is shown in FIGS. 24 to 26. This embodiment includes a circular central compartment 912 and outer arcuate compartments 914 and 916. To accommodate use with lighter golf bags, the outer arcuate walls 914*a* and 916*a* extend only partway down in a vertical direction, thus reducing the overall weight of the insert. As can be seen from FIG. 26, the lower portion of the insert has no outer arcuate walls and uses the inner surfaces of the golf bag to accommodate the golf clubs. As with the other embodiments, the central compartment 912 extends above the main body of the insert and the slots 922 are provided in the partial outer arcuate walls to accommodate the fastening straps.

Figure 28:
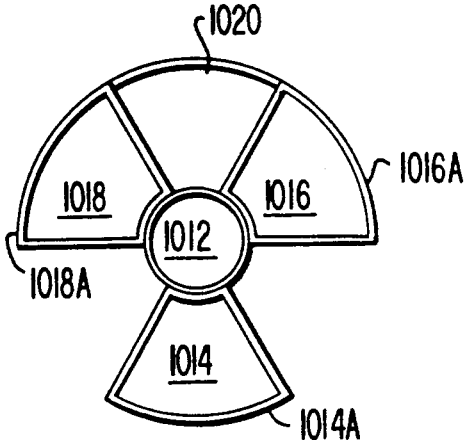
FIG. 28 is a top view thereof.
Figure 27:
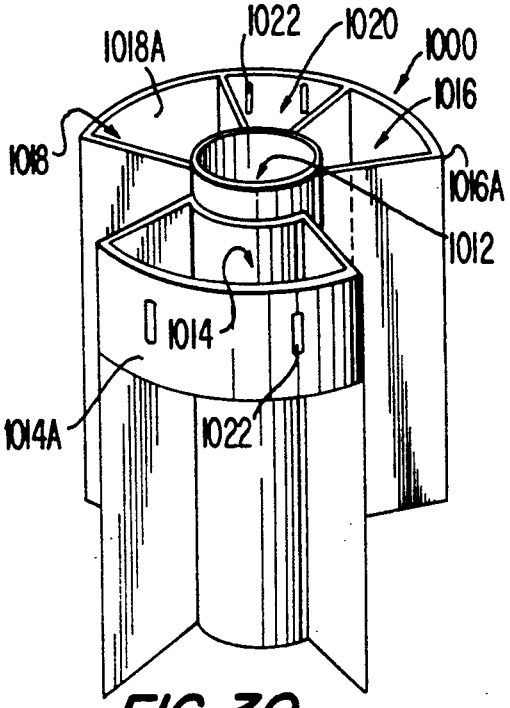
FIG. 27 is a perspective view of a further embodiment of the golf club insert of the present invention.

FIGS. 27 and 28 show a still further embodiment for golf club holder insert 1000 of the present invention including a circular central compartment 1012 and outer arcuate compartments 1014, 1016 and 1018, each of which include outer arcuate compartment walls 1014*a*, 1016*a* and 1018*a* which extend only partway in a vertical direction toward the bottom of the insert 1000 to reduce the overall weight of the insert. The insert also includes a spanner member 1020 to accommodate slots 1022 for securing the straps to connect the insert to the golf bag.

Figure 29:
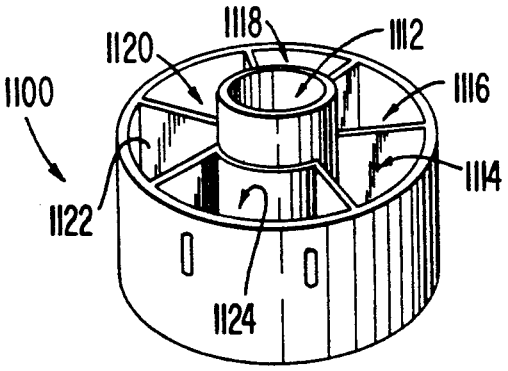
FIG. 29 is a perspective view of another embodiment of the present invention.
Figure 30:
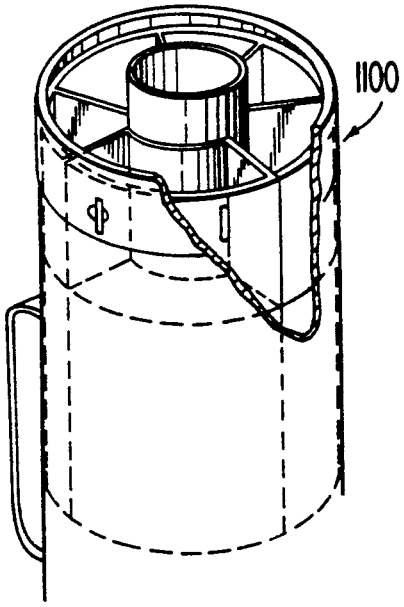
FIG. 30 is a perspective view, partly in section, of the golf club insert of FIG. 29 attached to a golf bag.

FIGS. 29 and 30 show an embodiment 1100 of the present invention which is designed to be permanently installed within the upper portion of a golf bag by gluing, stapling, sewing, welding or the like. In this embodiment, the insert 1100 extends only partway downwardly within the bag in a vertical direction. The shape and spacing of the compartments, including a circular central compartment 1112 and a plurality of arcuate compartments 1114, 1116, 1118, 1120, 1122 and 1124 around the outer periphery thereof are essentially the same as the embodiments described hereinabove. It will also be appreciated that the permanently installed club holder insert may extend the entire vertical length of the golf bag.

It will be appreciated that various changes and modifications may be made in the various structures described hereinabove. For example, but not by way of limitation, a variety of numbers of compartments may be provided, from a minimum of three to a maximum of fourteen separate compartments. Using the arcuate shapes in combination with the central circular compartment, the club holder insert provides openings which are easy to use and less tedious and which provide ample space and golf club arrangement possibilities. Other modifications and changes may be made in keeping within the scope of the following claims.

I claim:

1. A golf club holder insert for use with a golf bag, having an opening to hold a plurality of golf clubs of various lengths, the insert comprising:

an outer arcuate wall sized to fit within the opening of the golf bag;

a primary compartment, centrally located within said outer arcuate wall and structured to receive one or more longer length golf clubs;

a plurality of secondary compartments, interconnected between said outer arcuate wall and said primary compartment, and extending outwardly from said primary compartment; each of said secondary compartments structured to receive one or more shorter length golf clubs;

said primary compartment including an outer wall which extends vertically above said secondary compartments a sufficient distance to separate and protect the heads and shafts of the longer golf clubs in the primary compartment from the shorter golf clubs in the secondary compartments.

2. The golf club holder insert of claim 1 wherein said outer arcuate wall includes an upper edge and said primary compartment includes an upper rim located a distance above said upper edge of said outer arcuate wall; the distance between said upper rim and said upper edge defining a space to store the shorter golf clubs within said secondary compartments, whereby club heads of the shorter golf clubs are positioned below the upper rim of the primary compartment.

3. The golf club holder insert of claim 1 wherein the secondary compartments are positioned radially with respect to the centrally located primary compartment.

4. The golf club holder insert of claim 3 wherein said secondary compartments are formed by dividers located between the outer arcuate wall and the outer wall of the primary compartment.

5. The golf club holder insert of claim 1 wherein said primary compartment is cylindrical and said secondary compartments extend radially therefrom.

6. A golf club holder insert for placement in the opening of a golf bag; said insert including a plurality of divided compartments to facilitate separation and storage of golf clubs in said bag wherein the improvement comprises:

a first inner central compartment centrally located on said insert to receive a plurality of golf clubs;

a series of outer compartments radially disposed about said central compartment;

said central compartment extending in a vertical direction above the uppermost surfaces of said outer compartments, such that in use golf clubs stored in said central compartment are prevented from making contact with golf clubs stored in any of said radially disposed outer compartments.

7. The golf club holder insert of claim 6 further including an outer peripheral wall sized to conform with said golf bag opening and further including a plurality of dividers connected between said outer peripheral wall and said inner central compartment to form said series of outer compartments.

8. The club holder insert of claim 7 wherein the upper surface of said inner central compartment extends above said dividers.

* * * * *